US005941806A

United States Patent [19]

Olschansky et al.

[11] Patent Number: 5,941,806

[45] Date of Patent: Aug. 24, 1999

[54] EXERCISE DEVICE

[76] Inventors: Brad Olschansky; Scott Olschansky, both of 2003 Lake Park Dr., Smyrna, Ga. 30080

[21] Appl. No.: 08/832,114

[22] Filed: Apr. 3, 1997

[51] Int. Cl.[6] ..... A63B 23/02

[52] U.S. Cl. ..... 482/140; 482/132; 482/95; 482/93; 482/139

[58] Field of Search ..... 482/92, 93, 95, 482/96, 105, 107, 131–134, 139, 140, 142, 145, 907, 908; 601/23, 33; D21/191, 686–690

[56] References Cited

U.S. PATENT DOCUMENTS

| | | | |
|---|---|---|---|
| D. 385,929 | 11/1997 | Mishan | D21/191 |
| D. 386,226 | 11/1997 | Chen et al. | D21/191 |
| 3,817,243 | 6/1974 | Perrine | 482/140 |
| 4,508,335 | 4/1985 | Velley et al. | 482/140 |
| 4,752,067 | 6/1988 | Colonello . | |
| 4,902,003 | 2/1990 | Buoni . | |
| 5,300,005 | 4/1994 | Wang | 482/142 |
| 5,346,447 | 9/1994 | Stearn | 982/95 |
| 5,403,258 | 4/1995 | Hill | 482/145 |
| 5,407,404 | 4/1995 | Killian et al. . | |
| 5,492,520 | 2/1996 | Brown . | |
| 5,527,252 | 6/1996 | Sather | 482/142 |
| 5,545,114 | 8/1996 | Gvoich | 482/140 |
| 5,577,987 | 11/1996 | Brown . | |
| 5,591,111 | 1/1997 | Wang et al. . | |
| 5,630,778 | 5/1997 | Barreca | 482/132 |

OTHER PUBLICATIONS

Advertisement for AB Ectasy AB Rolling Machine (undated).

*Primary Examiner*—Jeanne M. Clark
*Attorney, Agent, or Firm*—Rosenberg, Klein & Bilker

[57] ABSTRACT

An exercise device is provided which rockingly interfaces with a support surface for performing a number of exercises and particularly is directed to performing reverse crunches. The exercise device includes a light easily foldable frame having a pair of laterally spaced curved rails movable by the action of the user's thighs when the user is positioned in a supine position on a support surface between the curved rails. The exercise device includes arcuate and rocker members which may be rotatably folded to provide a low volume storage mechanism space.

14 Claims, 6 Drawing Sheets

EXERCISE DEVICE

BACKGROUND OF THE INVENTION

FIELD OF THE INVENTION

The present invention pertains to an exercise device and more particularly to a manually operated exercise device particularly useful for exercises commonly referred to as reverse crunch exercises. In particular, this invention relates to an exercise device which may be easily folded and stored by the user in a relatively small volume. Still further, this invention relates to an exercise device which is mounted on a supporting surface and rockingly interfaces with respect to the support surface responsive to displacement and movement of a user. More in particular, this invention pertains to an exercise device which includes a pair of laterally displaced rails coupled to each other by a spacer bar where the user is located between the laterally spaced rails and through manual manipulation causes a rocking of the rails on the support surface. Still further, this invention pertains to an exercise device which includes a movement actuating bar member extending laterally from a first end of each of the curved rails and extends to a space between the curved rails for interface with the thighs of a user. More in particular, this invention relates to an exercise device which rockingly interfaces with a support surface and includes weight supporting members mounted to a second end of each of the curved rails to support at least one or more weight members which may be added or subtracted at the discretion of the user to benefit the exercising capabilities of the exercise device. Still further, this invention pertains to an exercise device where each of the rails are constructed of a rocker member as well as an arcuate member which are joined to each other in rotatable displacement by a mechanism for independently rotating the rocker member and the arcuate member about a longitudinal axis therebetween.

PRIOR ART

Manual exercise devices which rockingly interface with a support surface are known in the art. Numerous types of exercise devices have been developed for exercising particular groups of muscles of a user to enhance body building techniques, enhance muscle tone, as well as skeleton strengthening.

The best prior art known to Applicants include U.S. Pat. Nos. 5,492,520; 5,577,987; 4,902,003; 4,863,158; 5,591,111; 4,752,067; and, an exercise device which is entitled "Ab XTC Ecstasy" relating to a cross-training cruncher.

The closest prior art known to Applicants are U.S. Pat. Nos. 5,577,987 and 5,492,520, basically directed to abdominal exercise devices. Such devices as disclosed in these Patents is intended as abdominal exercise devices formed of a one-piece skeletal frame. Such frames define a pair of arcuate rocker portions, as well as a pair of arm rest sections with an upstanding arch-shaped support portion connecting laterally displaced support rail members to form a semi-closed contour.

In such prior art designs, the arm rest portions receive the elbows of the user when the user is in a supine position. Additionally, the head and neck of the user are supported on the support member extending across the arch-shaped section of the devices. When the user grasps the upstanding arch-shaped support and initiates lifting of the user's upper torso, a sit-up exercise is performed. The frame rocks forwardly which is caused by the pulling action of the hands of the user on the upstanding arch-shaped section and simultaneously by depressing action of the elbows on the arm rest portions of the device. The support, along with the head and the neck of the user, is also driven towards the knees of the user and after reaching a flexed position, the user returns to the supine position while rocking the skeletal frame in a rearward direction once again by the action of the hands and elbows.

Such systems, although possibly used for reverse crunch type exercises, does not aid or assist the user in exercising, since the skeletal frame of the devices remains stationary. Additionally, such devices do not provide for any foldability in the manner provided by the subject Application system. Any folding or collapsing of such systems is complicated and does not minimize the volume as is provided by the subject Patent Application system. Still further, such systems do not provide for any weight addition mechanism to vary the resistive forces as is provided by the subject Patent Application system.

With the "Ab XTC Ecstasy" device, such includes a pair of arch-shaped members coupled each to the other to form a closed contour and foldable towards each other in a longitudinal direction. Such prior art devices include a padded headrest at the apex of the arch-shaped members forming a part of the overall exercise frame. In such devices where a reverse crunch exercise is performed, the positioning of the user is similar to that used by the user in such devices for sit-ups with the knees being flexed toward the chest of the user. However, once again, the frame is substantially immovable during such reverse crunch exercises and does not assist the user in performing the reverse crunch exercise.

Still further, although such a device is collapsible by a rotation of the frontal and rear support frames, such is not foldable in the manner as provided by the subject Patent Application system.

Such prior art devices remain somewhat oversized due to the presence of the head as well as back supporting pads and the upstanding arch-shaped members for being grasped by the hands of the user. The carrying head, supporting pads and closed or semi-closed contour of the frames do not allow foldability into this minimal volume spacing of the subject Patent Application system. None of the prior art previously discussed is suited to performing a reverse crunch exercise, since the rocker motion of the frames are actuated by action of the hands and upper torso, but not through the action of the thighs or the lower body of the user.

Prior art devices such as that shown in U.S. Pat. Nos. 4,902,003 and 4,752,067 are directed to exercise devices which rockingly interface with a support surface, however, such are not adaptable for use in a reverse crunch exercise. Such devices are generally formed of one piece members which allow for rocking on the supporting surface, but do not provide for any interface of the thighs or lower body of the user with the exercise device for the purposes of providing reaction exercising forces. Additionally, such exercise devices do not provide for any allowable addition of weight elements, nor do they provide for foldability in the manner as set forth in the subject Patent Application system.

The subject system has been found to be highly desirable in exercising the abdomen, back, and thighs of a user through the combination of elements as herein described. In particular, the subject Patent Application exercise system provides for a minimal number of interfacing members which are easily foldable and are actuated by the thighs, legs, and the lower body of the user to assist in performing a reverse crunch exercise to maximize the benefits of the exercising steps.

SUMMARY OF THE INVENTION

It is an object of the present invention system to provide an exercise device particularly suited for performing an exercise commonly referred to as a reverse crunch which would maximize the benefits of the exercise.

It is another object of the present invention system to provide an exercise device which has a minimal number of interfacing members and which is easily foldable for storage in a minimal volume.

It is still a further object of the present invention to provide an exercise device with the ability to add or remove weight members which would add resistance for a reverse crunch movement for users of different exercise levels.

As has previously been stated, that present invention exercise device finds particular utility in the performance of reverse crunches, as well as for exercising abdomen, back, legs, and thighs of a user.

According to the teachings of the present invention, there is provided an exercise device to rockingly interface with a support surface. The exercise device includes a pair of curved rails which are laterally spaced from each other with each of the curved rails having first and second opposing ends. The rails have a rocker section, an arcuate section, and a substantially flat section joining the rocker and arcuate sections. The flat section of each rail extends in a longitudinal direction having a longitudinal axis. A spacer bar is included which extends between the curved rails and is connected transversely between the curved rails to the flat sections of each of the rails. A movement actuating bar extends laterally from the first end of each of the curved rails and in one embodiment, a weight supporting mechanism is mounted to the second end of each of the curved rails for supporting at least one weight member thereon.

A mechanism for independently rotating the rocker section, the arcuate section and the flat section about the longitudinal axis is also provided.

In a preferred embodiment of the subject Application system, a spacer bar includes first and second opposing ends as well as a tubular member which is fixedly coupled to the spacer bar at each of the first and second ends. The tubular member has longitudinally displaced opposing openings formed through a wall on opposing ends of the tubular member. The tubular member receives respective ends of the rocker and arcuate members to join these members and form the overall curved rail. Each of the rocker and arcuate members includes a spring operated push button which extend through the openings in the tubular member to fixedly couple all members each to the other. The push button spring member forms a releasable locking mechanism which position the rocker and arcuate members of each curved rail in a singular plane when activated. The locking mechanism includes the previously noted resiliently biased push buttons each secured at respective ends of the rocker and arcuate members. Each of the spring biased push buttons has two positions, namely (1) an upper position when a spring (or other resilient means) pushes the button in an extended displacement and maintains the button above the surface of the rocker and arcuate members, as well as (2) a lower position where the spring is displaced by a pressing action on the button opposing the action of the spring and the button is maintained in position flush with or slightly below the surface of the associated rocker or arcuate members. When a respective proximal end of the arcuate or rocker member is telescopically received in the opening of the tubular member and slides forwardly, the push button is maintained in its lower position until the push button has been aligned with the respective aperture or opening formed through the tubular member. The push button then extends through the aperture into the upper position thereby coupling the arcuate or rocker member to the tubular member in a fixed coupling mode. When in the fixed coupling mode, the respective rail forms a planar envelope. In order to release the rocker or arcuate member, or to fold the exercise device, the push button is then compressed by the user which then transfers or displaces the push button to its lower position and the arcuate or rocker member may be released from the tubular member for independent rotation within the tubular member about the longitudinal axis for allowing folding of the overall frame into a minimal volume.

A weight supporting mechanism has a weight support bar laterally extending from the arcuate section of each of the rails. Weight members of varying contour including disks having a central opening may be mounted on the weight support bar. The weight support bar is received within the central opening of at least one disk and the disk is secured to the weight support bar by a releasable clamp mechanism which captures the weight between a stop disk and the clamp on the weight support bar. Other mechanisms of mounting the weights on the weight support bar are envisaged by this invention concept, such as securing the weights by magnetic interaction between the weight supporting mechanism and the weight element itself.

Preferably, each movement actuating bar member has a thigh engaging portion and a hand grip associated therewith. The movement actuating bar may be covered by a resilient member such as a cushion member to enhance the tactile feeling of the user when doing the appropriate exercises. The rocker members and arcuate members of the rails are covered to a substantial degree by a sleeve formed of a non-slip material which increases the frictional coefficient with a support surface to minimize sliding and other unwanted displacements of the exercise device during the exercise procedure.

A pad may be secured to the spacer bar and underlies the back of the user while performing a reverse crunch type exercise. The pad may be in the form of a textile mat which is sandwiched between the back of the user and the supporting surface. Where such a mat or pad is used, such is flaccid in construction and is generally secured to the spacer bar in a manner which allows rolling of the mat onto the spacer bar to enhance the minimal volume foldability concepts as herein described.

As another aspect of the subject invention concept and directing itself to another aspect thereof, the present invention constitutes a method of performing reverse crunch exercises wherein the flat sections of the curved rails are positioned on the support surface and the person performing the exercises is positioned between the curved rails in the supine position on the support surface with the knees being flexed for performing the reverse crunch exercise. The movement actuating bar members engage the front surface of the thighs of the user and are driven substantially exclusively by an action of the thighs flexed towards the chest of the user. The movement actuating bar members cause the exercise device to roll forwardly about the rocker section of the curved rails. The weight members captured on the second ends of the curved rails provide for predetermined reaction resistance to a reverse crunch displacement. When the action of the thighs on the movement actuating bar members has been released, the weight elements cause the exercise device to move rearwardly to the initiating position thereof.

These and other objects, features and advantages of the subject invention concept will become more apparent from the following description of the preferred embodiment which is explained in connection with the accompanying Drawings.

DETAILED DESCRIPTION OF THE PREFERRED EMBODIMENTS

Figure 1:
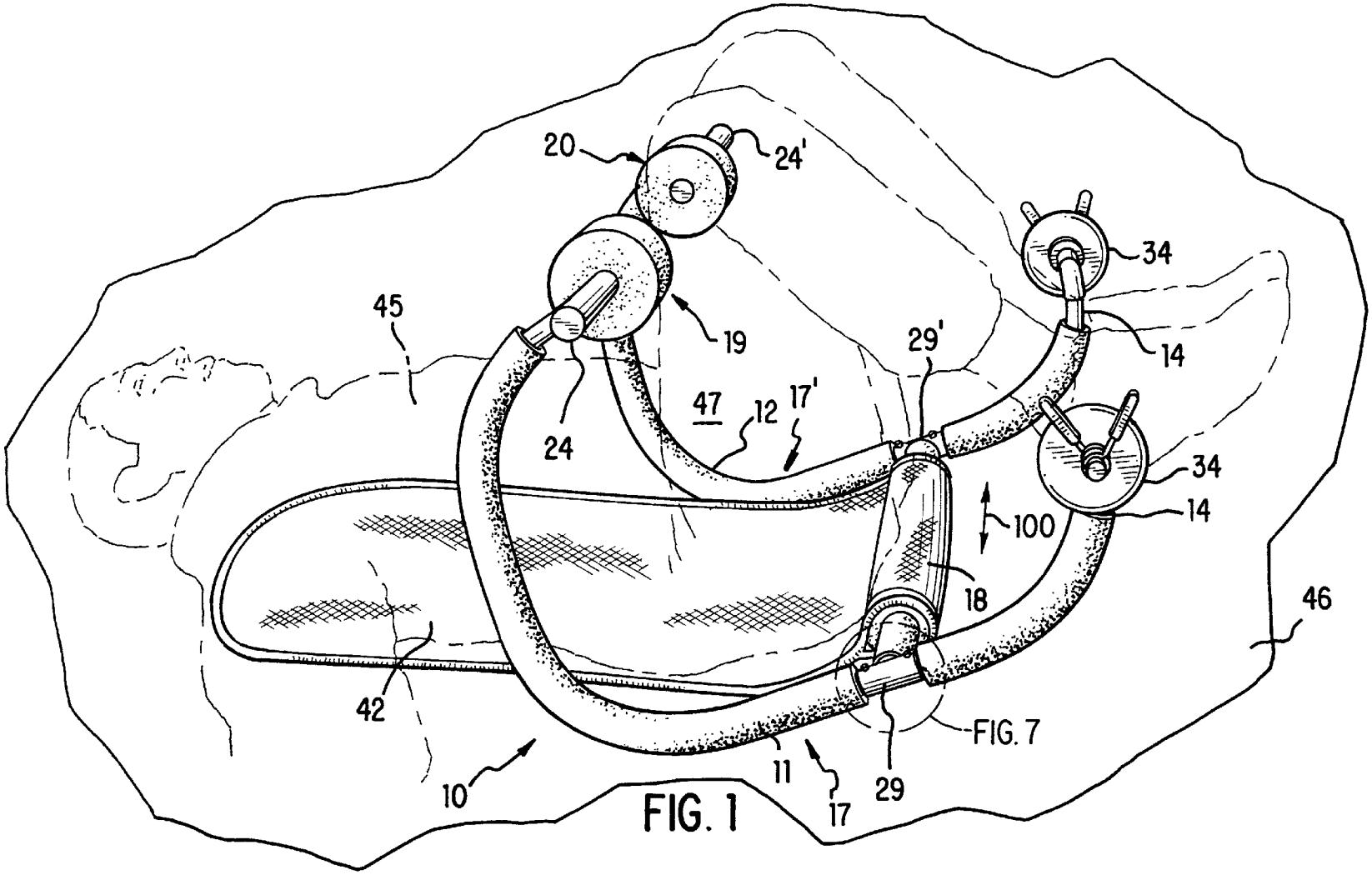
FIG. 1 is an isometric view of the subject exercise device of the present invention showing a user in the supine position and in phantom line performing a reverse crunch.
Figure 5:
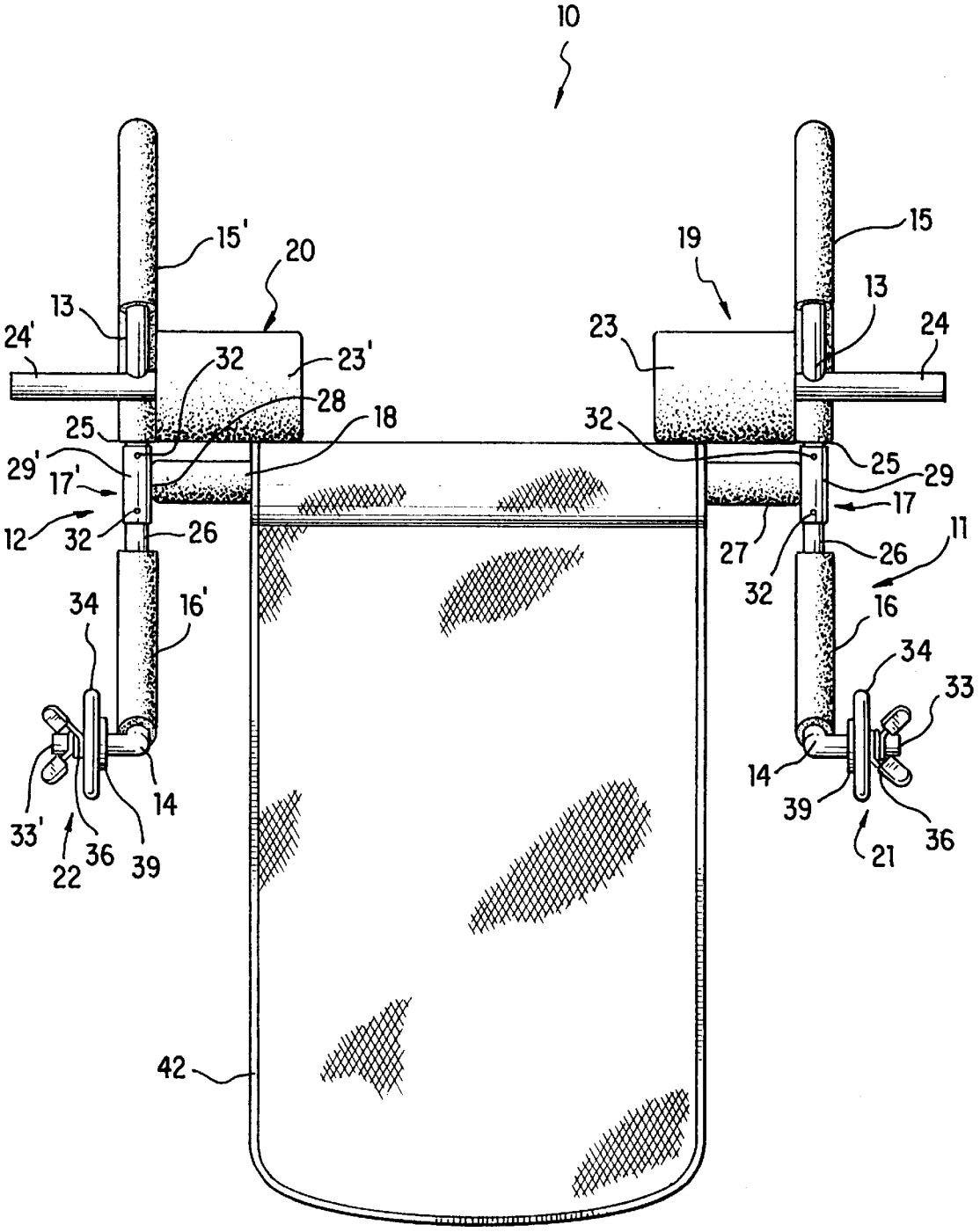
FIG. 5 is a planar view of the exercise device of the subject invention.
Figure 8:
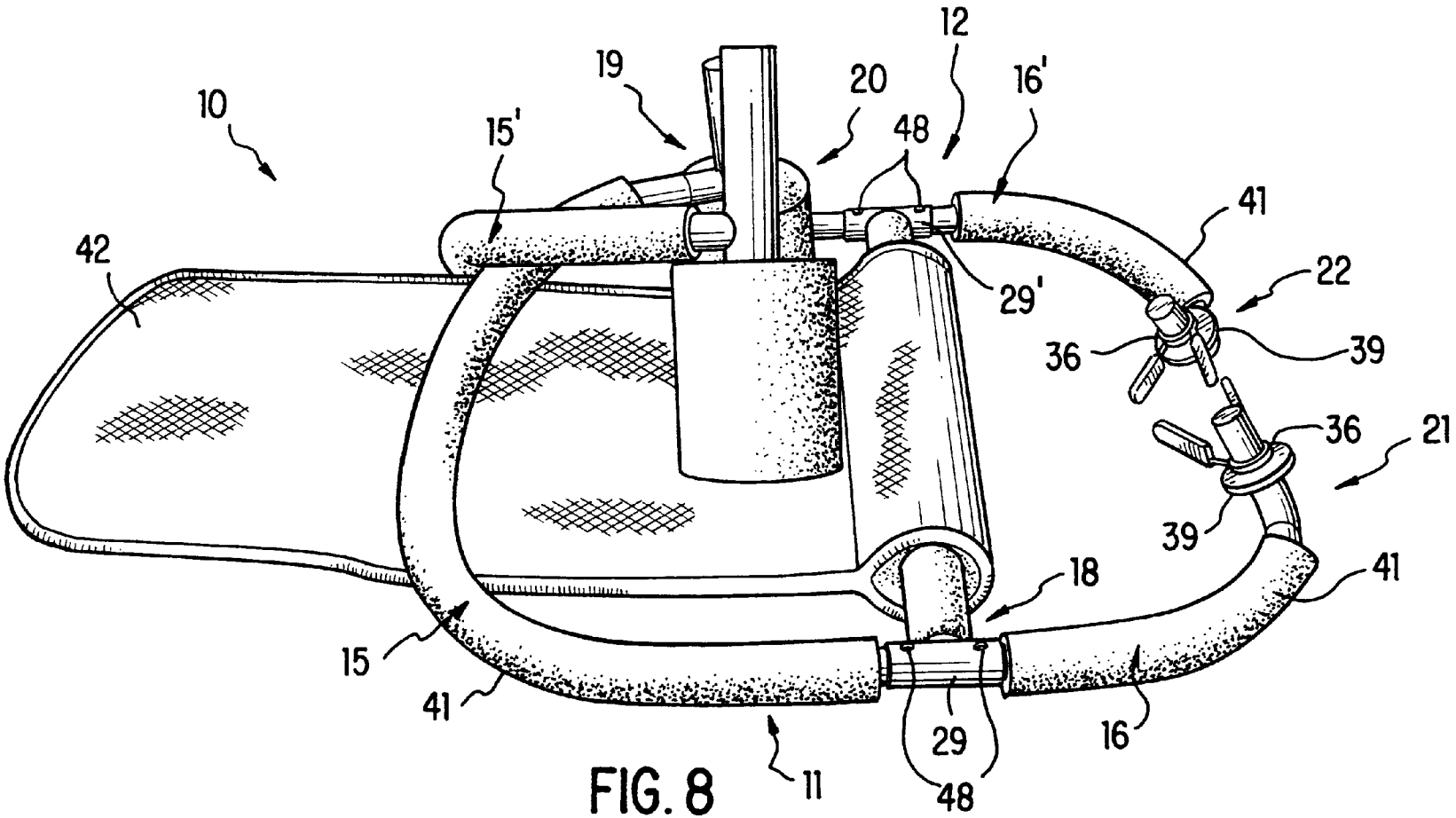

Referring now to FIGS. 1, 5 and 8, there is shown exercise device 10 for use in performing a multiplicity of exercises, however, of particular use for reverse crunch type exercises. Exercise device 10 as is seen, includes a pair of laterally displaced curved rails 11 and 12. Each of the curved rails 11 and 12 have a first end 13 and an opposing second end 14. Each of the overall rails 11 and 12 includes a rocker section, an arcuate section, and a substantially linear or flat section connecting the rocker and arcuate sections thereby forming the overall contour of the curved rails 11 and 12.

Rocker member 15 which is at least partially arcuately contoured forms the rocker section of curved rail 11 and defines a portion of flat section 17. Similarly, rocker member 15' forms the rocker section of curved rail 12 and defines a portion of flat section 17'. Arcuate member 16 forms the arcuate section and a portion of flat or linear section 17 of curved rail 11. Accordingly, arcuate member 16' forms the arcuate section and a portion of linear or flat section 17' of curved rail 12.

In order to form exercise device 10 into a cohesive and structurally joined frame, spacer bar 18 extends in lateral direction 100 shown in FIG. 1 between curved rails 11 and 12 and is fixedly secured at opposing ends thereof to provide a singular frame construction. As is seen, spacer bar 18 is fixedly secured to tubular members 29 and 29' through welding, bolting, or some like technique not important to the inventive concept as herein described, with the exception that the fixed coupling of spacer bar 18 to tubular members 29 and 29' are sufficiently rigid to provide a structural support which will accept the force loading imparted thereto. Additionally, spacer bar 18 may be formed of stainless steel, aluminum, or some like composition which provides sufficient structural integrity to allow a user to rockingly displace device 10 with respect to a supporting surface.

Figure 2:
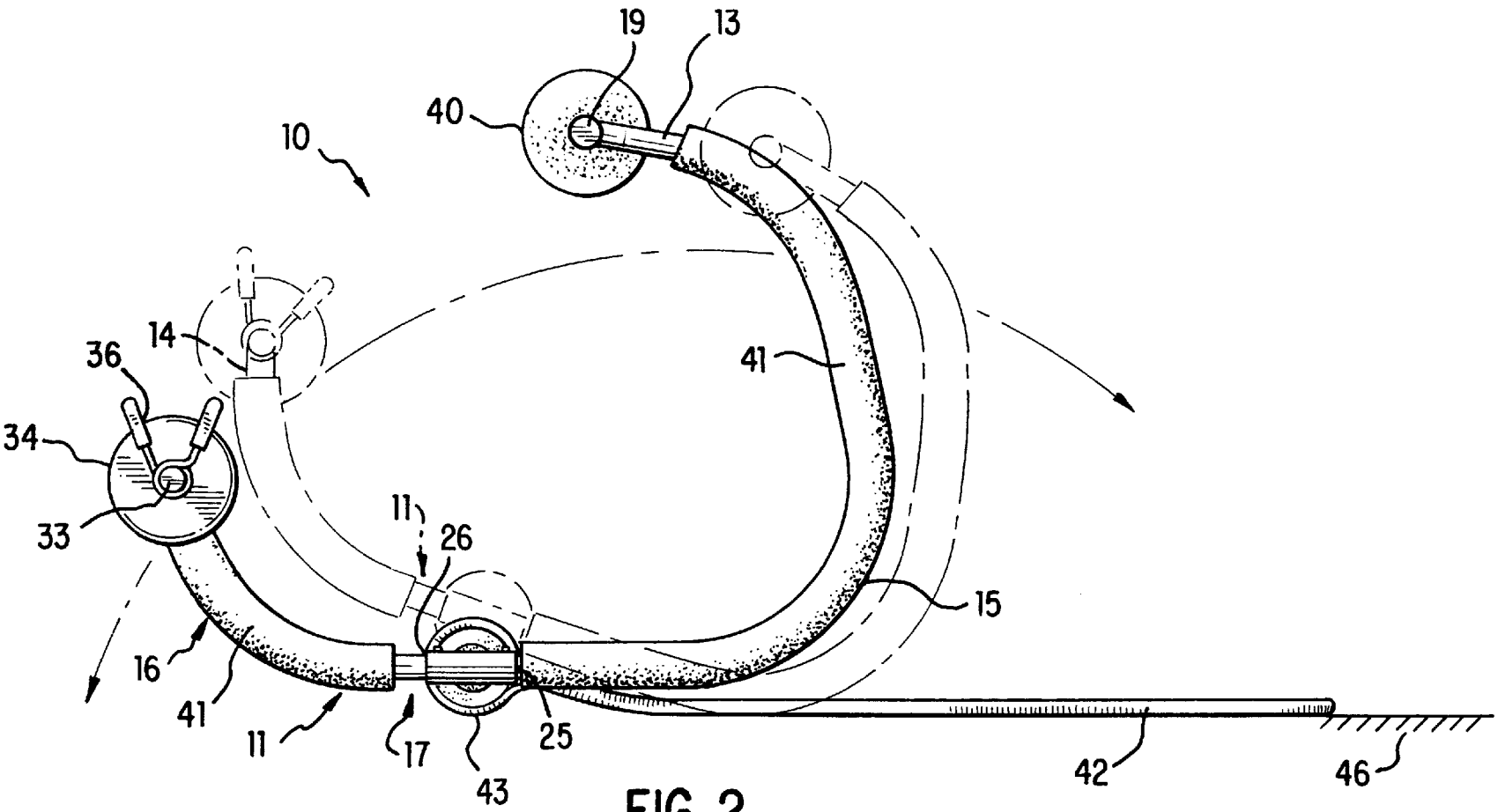
FIG. 2 is a side view of the exercise device of the subject invention showing a reverse crunch displacement of the device both in solid and phantom lines.
Figure 3:
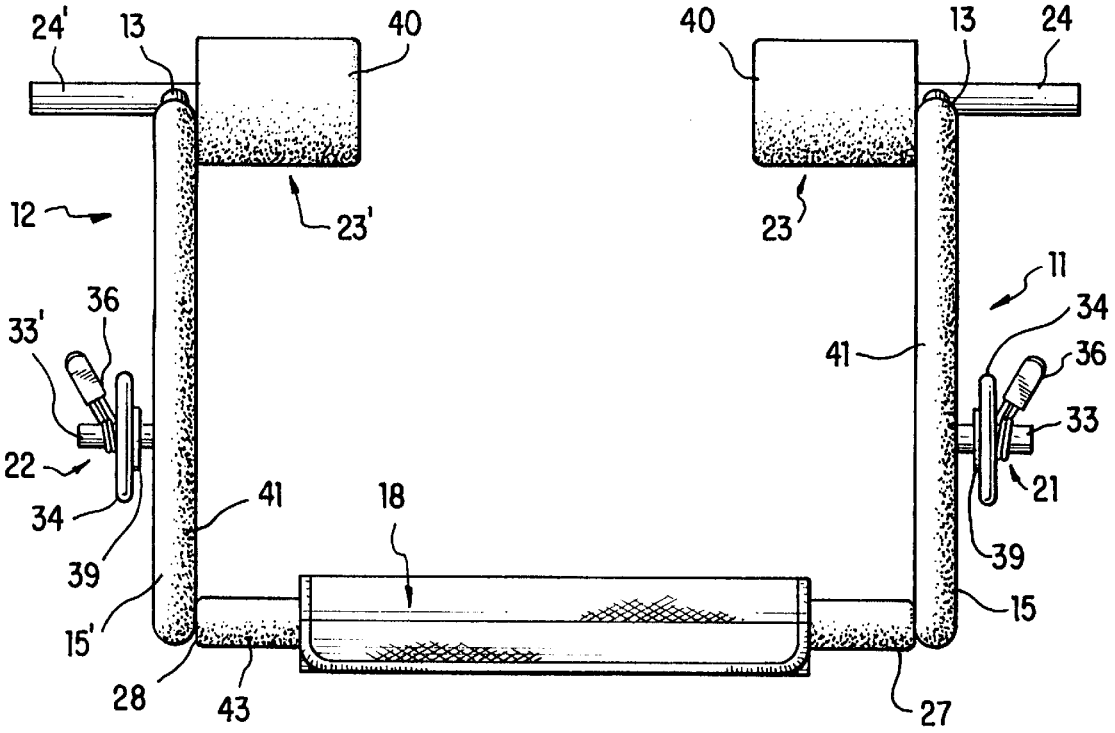
FIG. 3 is a frontal view of the subject exercise device of the present invention.
Figure 4:
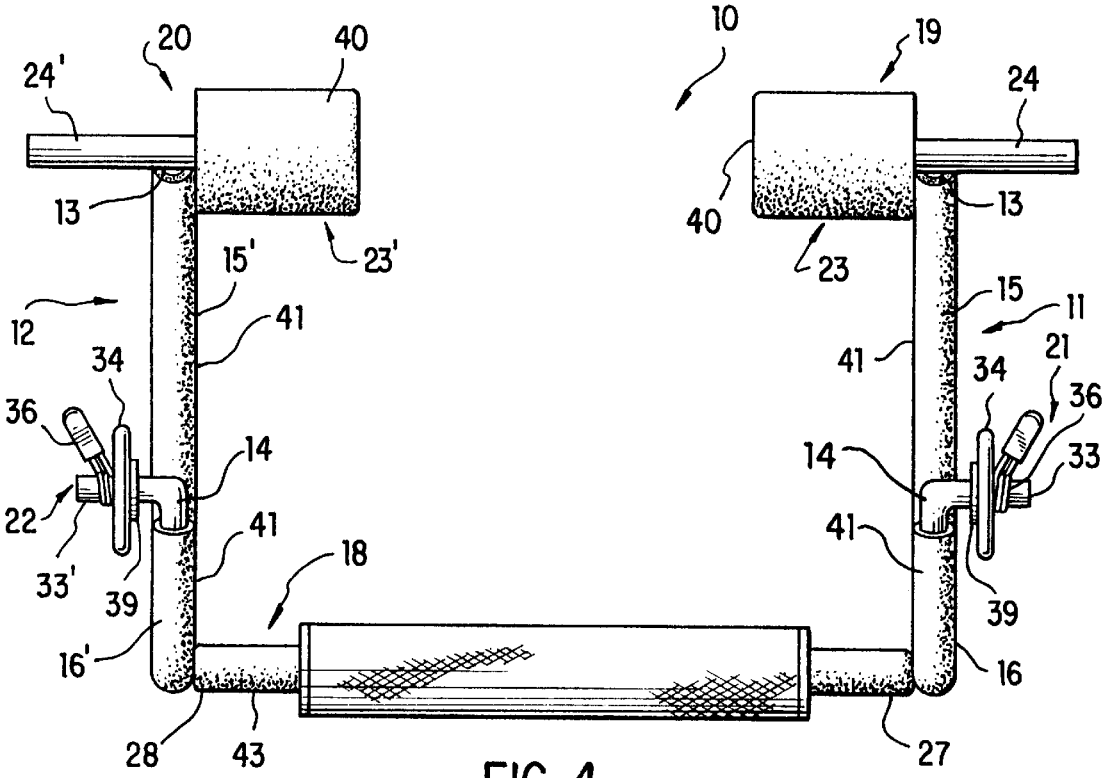
FIG. 4 is a rear elevational view of the exercise device of the subject invention.

As shown in FIGS. 1 and 2, movement actuating bar members 19 and 20 extend in lateral direction 100 at the first end sections 13 of respective curved rails 11 and 12. Movement actuating bar members 19 and 20 may be secured to rails 11 and 12 through welding, bolting, or some like technique, not important to the inventive concept as herein defined. Movement actuating bar members 19 and 20 extend substantially perpendicular to the planes or plane envelope of the curved rails 11 and 12 and as is shown clearly in FIG. 1, extend on opposing sides of respective rails 11 and 12. As will be described in following paragraphs, movement actuating bar members 19 and 20 include respective thigh engaging sections 23 and 23' and hand grip sections 24 and 24' for purposes and objectives to be further described.

Device 10 also includes weight support mechanisms 21 and 22 located at the second end 14 of curved rails 11 and 12.

As is seen in FIGS. 1, 3–5 and 8, movement actuating bar members 19 and 20 further include thigh engaging sections 23 and 23' which sections extend internal to the overall envelope of the frame. Hand grip sections 24 and 24' extend outwardly from exercise device 10.

Figure 7:
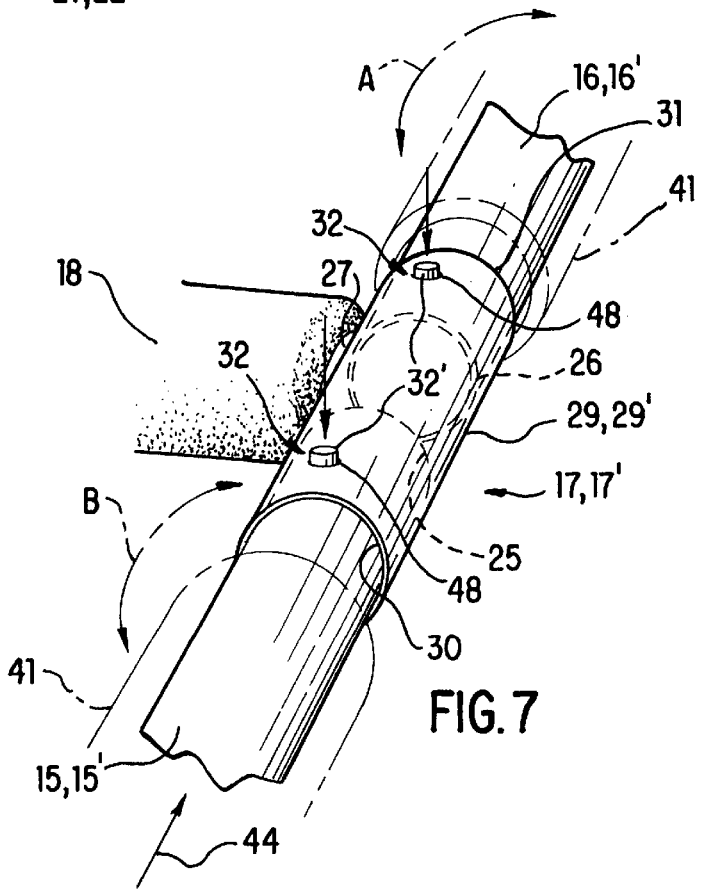
FIG. 7 is an isometric partially cut-away view of the arcuate and rocker members secured to a tubular member in a flat section of an overall rail; and, FIG. 8 is a perspective view of the subject exercise device of the present invention in the folded position for ease of storage and minimization of storage volume.

As is seen in FIG. 7, rocker members 15, 15' and corresponding arcuate members 16, 16' of respective curved rails 11, 12 are independent members which are displaceable each with respect to the other and adapted for fixed coupling each to the other during operation of exercise device 10. Rocker members 15, 15' have distal ends when taken with respect to the proximal ends which coincide with the first end of curved rails 11 and 12 and the rocker member 15 and 15' further includes a proximal end 25. The arcuate members 16, 16' have distal ends coinciding with the second ends 14 of the curved rails 11, 12 and further includes a proximal end 26.

The rocker members 15 and 15' as well as arcuate members 16 and 16' of the curved rails 11 and 12 are independent element members and may be displaced relative to each other. As has been previously noted, spacer bar 18 extending in lateral direction 100 includes first and second ends 27 and 28, respectively, and tubular member 29 and 29' is fixedly secured to first and second ends 27 and 28. The tubular members 29, 29' have longitudinally opposed openings 30 and 31 formed through a side wall of tubular members 29 and 29'. Rocker members 15, 15' are slidably received in the opening 30 shown in FIG. 7 of tubular members 29 and 29'. The arcuate members 16 and 16' are slidably received in the longitudinally directed opening 31 of the tubular members 29 and 29', as is further seen. When the proximal end of the rocker member 15, 15' is received in the opening 30 of tubular member 29 and the proximal ends 26 of the arcuate members 16, 16' are received in the opening 31 of the respective tubular members 29, 29', the rocker members 15, 15' and the arcuate members 16, 16' are independently rotatable about longitudinal axis 44 in a direction defined by directional arrows A and B in FIG. 7. Locking mechanism 32 fixedly couples the rocker members 15, 15' and arcuate members 16, 16' within tubular members 29, 29' in a predetermined position defining a locking mode. The arcuate members 16, 16', flat section 17, 17', and the rocker members 15, 15' in combination form the overall contour of the curved rails 11, 12 in order that all portions of the curved rails 11, 12 are positioned in substantially the same plane forming a planar envelope. Locking mechanism 32 can be any conventional locking mechanism suitable for the purposes and objectives as herein detailed.

In a preferred embodiment of device 10, locking mechanism 32 may include a pair of resiliently biased push buttons 32' secured to respective ends 25 and 26 of rocker members 15 and 15' as well as arcuate members 16 and 16'. The tubular members 29 and 29' have a pair of apertures or openings 48 formed through a sidewall of tubular members 29 and 29' for receiving push buttons 32'.

Each of push buttons 32' have two positions, namely, (1) an upper position when a spring or other resilient mechanism, not shown but conventional in the art, pushes or displaces the button 32' out of the rocker member 15 or 15' or the arcuate members 16 and 16' and maintains the button 32' above the outer surface of an outer wall of either tubular member 29 or 29', and (2) a lower position where push buttons 32' are displaced by a pressing action in opposition to a biasing force by the internal spring whereby push button 32' is maintained in position flush with or below the surface of a respective rocker member 15 or 15' or arcuate members 16 or 16'.

When the arcuate members 16, 16' or rocker members 15, 15' are telescopically received in the respective openings 30 and 31 of the tubular members 29, 29' and are slidably displaced, push buttons 32' are in their lower position until push buttons 32' are aligned in a respective aperture 48 on the tubular members 29 and/or 29'. At this time, push button 32 is displaced through an appropriate aperture 48 into the upper position thereby coupling arcuate members 16, 16' or rocker members 15, 15' to the tubular members 29, 29' in predetermined relation and provides for fixed coupling therebetween. In this mode, curved rails 11 and 12 each define a planar envelope.

In order to release rocker or arcuate members from a fixed coupling position or when the user wishes to fold device 10, push buttons 32' are compressed and displaced by the user, thereby transferring push buttons 32' to the lower position as has previously been defined and the arcuate or rocker members can be telescopically released from the tubular member 29, 29', or alternatively may be rotated within tubular members 29, 29' for folding the exercise device into a position as is shown in FIG. 8.

Figure 6:
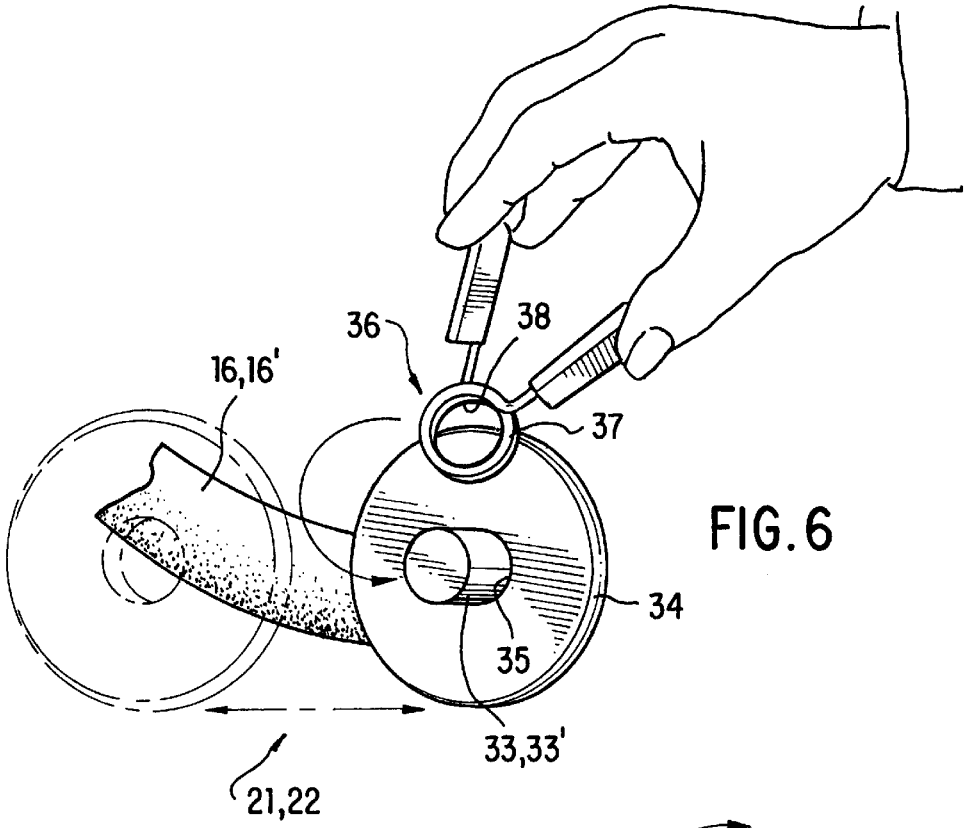
FIG. 6 is a partial cut-away isometric drawing showing a weight supporting mechanism of the subject invention.

It will be understood by those skilled in the art that dimensions of openings 30 and 31 of tubular members 29, 29' are chosen to snugly accommodate proximal ends 25 and 26 of the rocker members 15, 15' and arcuate members 16, 16' in order to provide a tight connection therebetween while allowing slidable displacement. In this manner, rocker members 15, 15' and arcuate members 16, 16' may not be loosened from tubular members 29 or 29' when locking mechanism is not actuated. As is seen in FIGS. 1–6 and 8, weight supporting mechanisms 21 and 22 include respective weight support bars 33 and 33' which extend laterally at the ends 14 of the arcuate members 16, 16'. Weight members 34 which may be in the form of weight disks, generally have a central opening 35 formed therethrough. Weight support bars 33, 33' of the weight supporting mechanisms 21, 22 are received within the central openings 35 of at least one weight disk member 34 and the disk 34 may then be captured to weight support bars 33, 33' by clamping mechanism 36 as is shown in FIG. 6, or alternatively, may be captured by another mechanism such as magnetic attraction.

Clamping mechanism 36 may be any one of a number of well-known commercially available clamps and in the particular preferred embodiment, there is provided a pair of compressible handles connected by resilient spring 37 as shown in FIG. 6. Resilient spring 37 may be bent in a manner such that it forms an eye opening 38. When handles of clamping mechanism 36 are displaced towards each other, eye opening 38 increases in diameter and may then be slid and located on weight support bars 33, 33' in order to sandwich disk 35 on weight support bars 33, 33' between clamping mechanism 36 and stop member 39 shown in FIGS. 3 and 4. As has been stated, in order to mount clamping mechanism 36 on weight support bars 33 and 33', the handles of the clamp mechanisms 36 are compressed and displaced towards each other. The handles of clamping mechanism 36 are released and the opening 38 will then diminish in diameter for interface with the external surface of weight support bars 33, 33' in a frictional fit. In this manner, disk members 34 are secured to the weight supporting mechanism 21, 22. Stop member 39 on weight support bars 33, 33' simply provides a structural member to allow sandwiching of the weight disk 34 between the clamping mechanism 36 and the stop member 39.

A cushion member 40 may be mounted or located on thigh engaging sections 23 and 23' of movement actuating bar members 19 and 20 to engage with the thighs of the person performing exercises. Cushion member 40 may be slidably removable or may be formed integral with the thigh engaging sections 23 and 23' of the movement actuating bar members 19 and 20. Cushion 40 is generally formed in a tubular contour and may be a cylindrical member formed of resilient material such as open cell plastic or foam rubber which may be sleeved onto the free end of thigh engaging portions 23 and 23'.

Similarly, rocker members 15, 15' and arcuate members 16, 16' are substantially covered with sleeve 41 formed of a non-slip material such as rubber or the like. Sleeve 41 serves to maintain the exercise device 10 in a stable position when being used during the exercise procedure. Sleeve 41 may be formed of a friction type material so as to provide a non-slip type surface to retard exercise frame from slipping on the support surface during an exercise program.

As is seen in FIGS. 5 and 8, there may be included a pad or mat 42 secured to spacer bar 18. Pad 42 may be formed of any suitable cushioning material with a preferred non-slip surface and may be formed of a textile or other like composition. Pad 42 may be rolled or wound on spacer bar 18 to further minimize volume when the exercise device is being folded and stored. Pad 42 is generally flaccid in texture and as is seen in FIG. 1, is sandwiched between the user 45 and any supporting surface 46. Pad 42 adds to the comfort of user 45 during exercises and isolates the user's body from supporting surface 46 to both maintain any unwanted debris from contacting the user's body and further, to allow for additional frictional engagement of exercise device 10 with supporting surface 46.

Spacer bar 18 may be surrounded by cushion 43 generally formed of a similar material as cushion 40. As is seen in FIGS. 1–5 and 8, exercise device 10 forms an open frame housing contour where first ends 13 of curved rails 11 and 12 and second ends 14 are disposed in a longitudinally displaced manner each from the other. Exercise device 10 is devoid of members which would close the contour of the overall frame, thereby substantially reducing weight and size of exercise device.

Where user 45 wishes to perform exercises such as reverse crunches, user 45 positions himself/herself between curved rails 11 and 12 in a supine position on support surface 46. Initial positioning of user 45 is generally with the knees of user 45 flexed and with the user's feet on support surface 46. In the initial position, thighs 47 of user 45 engages thigh engaging sections 23 and 23' of exercise device 10. Preferably, user 45 does not use his/her hands to aid in performance of a reverse crunch and thus, user 45 may keep his/her hands and arms beneath the neck, located on the user's chest, or on support surface 46. Dependent upon the exercise level and skill of user 45, they may wish to grasp hand grips 24, 24' and during the exercising procedure pull hand grips 24, 24' towards the chest, thereby reducing the loading on the muscles of the lower body, as well as the abdomen.

Referring to FIG. 1, during reverse crunch exercises, the user 45 initiates the procedure by flexing his/her knees towards the user's chest such that movement actuating bar members 19 and 20 are driven or pushed by the action of thighs 47 towards the chest of user 45. The action of thighs 47 on movement actuating bar members 19 and 20 causes exercise device 10 to roll in an interfacing manner with support surface 46 in a forward direction toward the chest of user 45 about rocker sections of curved rails 11 and 12.

During this exercise, the central abdominal, oblique abdominals, quadriceps, legs, and deep back muscles are force loaded to the extent depending on weight provided at weight supporting mechanism 21 and 22. Each user 45 may adjust the weight according to the preferred resistance he/she desires to overcome and depending on the purposes of the exercising procedure. Once action of thighs 47 on movement actuating bars 19, 20 have been released, weights 34 cause exercise device 10 to move rearwardly to the initiating position of exercise device 10 on supporting surface 46. The number of repetition of forward and rearward movements of device 10 may be varied depending on a number of factors not important to the inventive concept as herein described, such as medical requirements, or a particular exercise program to be completed by user 45.

In order to perform a reverse crunch, user 45 has to move his/her thighs and knees towards the chest and there is no need to displace any of the upper body muscles. Exercise device 10 provides a maximizing effect for exercising of abdomen, thighs, legs, and lower back muscles. Exercise device 10 is devoid of any moving or relatively moving machine parts or members to perform an exercise routine. User 45 is able to determine the extent to which exercise device 10 is to be utilized and for example, user 45 may flex his/her knees into a lower position, intermediate position, or into a fully flexed position directed toward the chest.

Exercise device 10 of the subject invention concept includes a minimal number of structural members including three members essentially defining curved rails 11 and 12 with the addition of the spacer bar 18 which is easily foldable, as is seen in FIG. 8. In order to fold exercise device 10 after performing a particular exercising program, locking mechanism 32 is deactuated for releasing rocker members 15 and 15' and arcuate members 16 and 16' as has previously been described. The arcuate members 16, 16' may then be folded towards each other and may be disposed in substantially the same plane. Rocker members 15, 15' may also be folded towards each other as shown in FIG. 8 with the exercise device 10 being formed into a very compact small volume structure which is convenient for storage purposes.

It is to be understood by those skilled in the art that weight members 34 are to be removed prior to folding exercise device 10 for storage. Exercise device 10 of the present invention concept may be formed in different sizes to be suitable for users of different ages and body contour.

All parts of exercise device 10 may be formed of tubular members of a light metal such as aluminum, stainless steel, or may be plastic members to decrease the overall weight of device 10. Inherent simplicity of the use and structural component interfacing of exercise device 10 allows such to be produced in high quantities at relatively low consumer costs.

Although this invention has been described in connection with specific forms and embodiment thereof, it will be appreciated that various modifications other than those discussed above may be resorted to without departing from the spirit or scope of the invention. For example, functionally equivalent elements may be substituted for those specifically shown and described, proportional quantities of the elements shown and described may be varied, and in the formation method steps described, particular steps may be reversed or interposed, all without departing from the spirit or scope of the invention as defined in the appended Claims.

What is claimed is:

1. An exercise device for rockingly interfacing with a support surface, comprising:

a pair of curved rails laterally spaced each from the other, each of said curved rails having first and second opposing ends, said rails having a rocker section, an arcuate section and a substantially flat section joining said rocker and arcuate sections, said flat sections extending in a longitudinal direction and having a longitudinal axis, said rails including (a) a rocker member at least partially arcuately contoured, said rocker member forming said rocker section and at least a portion of said flat section of a respective rail, (b) an arcuate member forming said arcuate section of said rail, and at least a portion of said flat section of a respective rail, and (c) means for independently rotating said rocker member and said arcuate member about said longitudinal axis, said means for independently rotating including a tubular member slidingly interfaced with a proximal end of each of said rocker and arcuate members;

a spacer bar extending between said curved rails and fixedly connected transversely therebetween to a respective tubular member on opposing ends thereof;

a movement actuating bar member extending laterally from at least one of said curved rails; and weight supporting means mounted to said second end of at least one of said curved rails and being capable of supporting at least one weight member thereon.

2. The exercise device as recited in claim 1 where said tubular member telescopingly receives said proximal ends of said rocker and arcuate members.

3. The exercise device as recited in claim 2 including releasable locking means for (1) fixedly coupling each of said rocker members and said arcuate members to said tubular member, and (2) releasing said arcuate and rocking members from said tubular member for allowing respective rotation about said longitudinal axis.

4. The exercise device as recited in claim 3 where said releasable locking means includes a pair of spring biased button members located within said proximal ends of said rocker and arcuate members for alignment with a pair of openings formed through a wall of said tubular member.

5. The exercise device as recited in claim 3 where said arcuate member and said rocker member form a planar envelope when fixedly coupled to said tubular member.

6. An exercise device for rockingly interfacing with a support surface, comprising:

a pair of curved rails laterally spaced each from the other, each of said curved rails having first and second opposing ends, said rails having a rocker section, an arcuate section and a substantially flat section joining said rocker and arcuate sections, said flat sections extending in a longitudinal direction having a longitudinal axis;

a spacer bar extending between said curved rails and connected transversely therebetween to said flat sections;

a movement actuating bar member extending laterally from at least one of said curved rails, said movement actuating bar member extending substantially normal to at least one of said rails, said movement actuating bar member extending laterally on opposing sides of said at least one of said rails for forming a hand grip section and a thigh engaging section; and, weight supporting means mounted to said second end of at least one of said curved rails and being capable of supporting at least one weight member thereon.

7. The exercise device as recited in claim 6 including a cushion member mounted to said thigh engaging section of said movement actuating bar member.

8. The exercise device as recited in claim 6 where each of said rails is substantially enclosed by a resilient sleeve member for increasing a frictional coefficient between said rails and said support surface.

9. The exercise device as recited in claim 6 including a pad member coupled to said spacer bar and extending between said rails.

10. An exercise device for rockingly interfacing with a support surface, comprising:

a pair of curved rails laterally spaced each from the other, each of said curved rails having first and second opposing ends thereof, said rails having a rocker section, an arcuate section and a substantially flat section joining said rocker and arcuate sections, said flat sections extending in a longitudinal direction having a longitudinal axis;

a spacer bar extending between said curved rails and connected transversely therebetween to said flat sections;

a movement actuating bar member extending laterally on opposing sides of each of said rails in a direction normal to said curved rails to form a hand grip section and a thigh engaging section.

11. The exercise device as recited in claim 10 where each of said rails includes:

(a) a partially arcuately contoured rocker member, said rocker member forming said rocker section and at least a portion of said flat section of a respective rail; and (b) an arcuate member forming said arcuate section of a respective rail and at least a portion of said flat section of said rail.

12. The exercise device as recited in claim 11 including weight supporting means mounted to said second end of each of said curved rails and being capable of supporting at least one weight member thereon.

13. The exercise device as recited in claim 12 including means for releasably capturing a weight member to said weight supporting means.

14. The exercise device as recited in claim 12 including resilient interface means mounted to said movement actuating bar for interfacing with a thigh portion of a user.

* * * * *